US009189906B2

(12) United States Patent
Sackfield

(10) Patent No.: US 9,189,906 B2
(45) Date of Patent: Nov. 17, 2015

(54) COIN TRANSPORT MECHANISM

(71) Applicant: Innovative Technology Limited, Oldham (GB)

(72) Inventor: Martin Sackfield, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 14/277,353

(22) Filed: May 14, 2014

(65) Prior Publication Data

US 2015/0001236 A1 Jan. 1, 2015

(30) Foreign Application Priority Data

Jun. 26, 2013 (GB) ..... 1311322.0

(51) Int. Cl.
*G07D 3/00* (2006.01)
*G07D 9/00* (2006.01)
*G07D 3/14* (2006.01)

(52) U.S. Cl.
CPC ..... *G07D 9/008* (2013.01); *G07D 3/00* (2013.01); *G07D 3/14* (2013.01)

(58) Field of Classification Search
CPC ..... G07D 3/128; G07D 3/06; G07D 3/02; G07D 3/16; G07D 9/008; G07D 3/00; G07D 3/10; G07D 9/065; G07D 3/04; G07D 9/00; G07D 1/00; G07D 9/04; G07D 3/14; G07F 1/047
USPC ..... 453/10, 12, 13, 33–35, 49, 57
See application file for complete search history.

(56) References Cited

U.S. PATENT DOCUMENTS 3,174,488 A * 3/1965 Rau ..... G07D 3/10 453/3
3,726,378 A * 4/1973 Simons ..... G07D 1/04 194/290
4,376,442 A * 3/1983 Gomez ..... G07D 3/10 453/32
4,548,220 A 10/1985 Le Hong et al.
5,240,099 A * 8/1993 Brown ..... G07B 15/066 194/317
5,285,883 A * 2/1994 Le Hong ..... G07B 15/066 194/317
5,295,899 A * 3/1994 Adams ..... G07D 9/008 453/10
5,607,351 A 3/1997 Schwartz
5,931,731 A * 8/1999 Chwalisz ..... G07D 9/008 377/7
6,193,599 B1 * 2/2001 Kurosawa ..... G07D 1/02 453/57
6,729,461 B2 * 5/2004 Brandle ..... G07D 3/06 194/317
2002/0077056 A1 6/2002 Abe et al.

(Continued)

FOREIGN PATENT DOCUMENTS

EP 0 834 842 A1 4/1998
EP 2 518 698 A1 10/2012
WO PCT/GB2006000249 8/2006

*Primary Examiner* — Jeffrey Shapiro
(74) *Attorney, Agent, or Firm* — Woodard, Emhardt, Moriarty, McNett & Henry LLP

(57) ABSTRACT

A coin transport mechanism comprising: a first coin rotor including at least one coin receptacle for receiving a coin; a second coin rotor including at least one coin receptacle, the second coin rotor disposed proximal to the first coin rotor; wherein the first coin rotor is noncoplanar with the second coin rotor and includes a gated coin aperture, and wherein the second coin rotor is adapted to transport coins from a coin hopper to the first coin rotor.

3 Claims, 7 Drawing Sheets

(56) References Cited

U.S. PATENT DOCUMENTS

2003/0148729 A1* 8/2003 Abe ..... G07D 9/008 453/57
2006/0278495 A1* 12/2006 Umeda et al. ..... 194/303
2007/0212998 A1* 9/2007 String ..... G07D 9/008 453/57
2010/0072024 A1* 3/2010 O'Byrne ..... G07D 3/128 194/302
2014/0238816 A1* 8/2014 Martin ..... 194/217

* cited by examiner

COIN TRANSPORT MECHANISM

The present invention relates to a mechanism or apparatus for the transportation and distribution of tokens or discoid objects. Specifically, but not exclusively, the present invention relates to a coin transport mechanism for a coin hopper or the like.

Various types of coin hopper are known in the art, and coin hoppers have many applications. Coin hoppers are often installed in gaming machines for the collection and holding of coins received from users of the machine. Generally, the bulk coins held in a coin hopper constitute a supply of coins for the purpose of payout.

Typically, the gaming machine coin insertion slot is positioned at eye-level and the coin hopper is disposed at a lower level within the gaming machine. Coins input via the insertion slot are gravity-fed to a receiving compartment where they are separated into individual coins and a determination of their authenticity is made using standard techniques.

Once a coin is determined to be authentic it is generally stored either in the coin hopper or within a larger storage container for future collection.

When a payout procedure is initiated, the requisite coins for payout need to be transferred from the hopper to a payout receptacle from where the coins can be collected by the payee. Conventionally, the payout receptacle is at a position lower than the coin hopper so that the action of payout is predominantly powered by gravity. However, this creates a problem in that the combination of the coin input channel and the coin output channel occupies a significant amount of the internal space of the gaming machine that could be better utilised by other devices that add to the functionality, and hence attractiveness, of the gaming machine.

A conventional solution to the above mentioned problem is to locate the payout receptacle proximal to the coin insertion slot so that the amount of internal space occupied by coin conduits is minimised. However, this approach leads to an increase in the complexity and cost of the gaming machine since it requires that a mechanical transport means is employed to transport the coins against gravity from the coin hopper to the payout receptacle. Typical mechanical transport means include a conveyor belt system or paternoster-type device, but either of these conventional approaches does not minimise space usage since a significant volume of the internal capacity of the gaming machine is still required to house the transport means.

The present invention arose from an attempt to address some or all of the aforementioned problems associated with the prior art.

According to an aspect of the present invention there is provided a coin transport mechanism as defined in claim 1.

Preferably, the first coin rotor and the second coin rotor are mounted on a common inclined support structure with the first coin rotor positioned above the second coin rotor. Advantageously, this enables coins to be raised from the coin hopper by operation of two substantially identical rotors disposed proximal to one another. Consequently, the volume of space required for the mechanism is minimised.

Preferably, the common support structure is integral to a base section of the coin hopper, and the first coin rotor is housed within a coin receiving compartment disposed within the coin hopper. The coin receiving compartment includes an aperture communicating with the second coin rotor.

Advantageously, the first coin rotor includes a plurality of radially projecting arm members which upon rotation of the first coin rotor traverse a substantially circular coin path disposed circumferentially of the first coin rotor. Consequently, a coin expelled from the gated coin aperture is urged to traverses the circular coin path by one of the plurality of radially projecting arm members.

In an alternative embodiment the circular coin path includes: a retractable coin ejector that is operable to eject passing coins out of the circular coin path to fall under gravity into the coin hopper; a solenoid activated trap door communicating with a coin storage container; and at least one diverter member for guiding a coin from the substantially circular coin path to a coin output path.

Preferably, a section of the substantially circular coin path traverses a coin sensor module adapted to provide signals indicative of coin characteristics, and another section of the coin path is disposed beneath the second coin rotor.

Preferably, the substantially circular coin path and the coin output path are disposed beneath the common support structure, and a section of the coin path coincident with the retractable coin ejector is exposed through the common support structure.

In a preferred embodiment, the diameter of the first coin rotor is substantially equal to the diameter of the second coin rotor, and both rotors include a plurality of coin receptacles and both are operably interconnected via a gearing train.

Advantageously, the gearing train is driven by a single motor, and the first coin rotor and the second coin rotor can be driven separately or together via operation of an adjustable gear wheel moveable between a first position in which only the first coin rotor rotates, a second position in which only the second coin rotor rotates, and a third position in which both the first and the second coin rotors rotate.

Preferably, both the first coin rotor and the second coin rotor include coin diverter means comprising at least one projection adapted to urge a coin radially outward.

According to a further aspect of the present invention there is provided a coin transport method as defined in claim 26.

An embodiment of the present invention will now be described, by way of example only, with reference to the accompanying drawings, in which.

Figure 1:
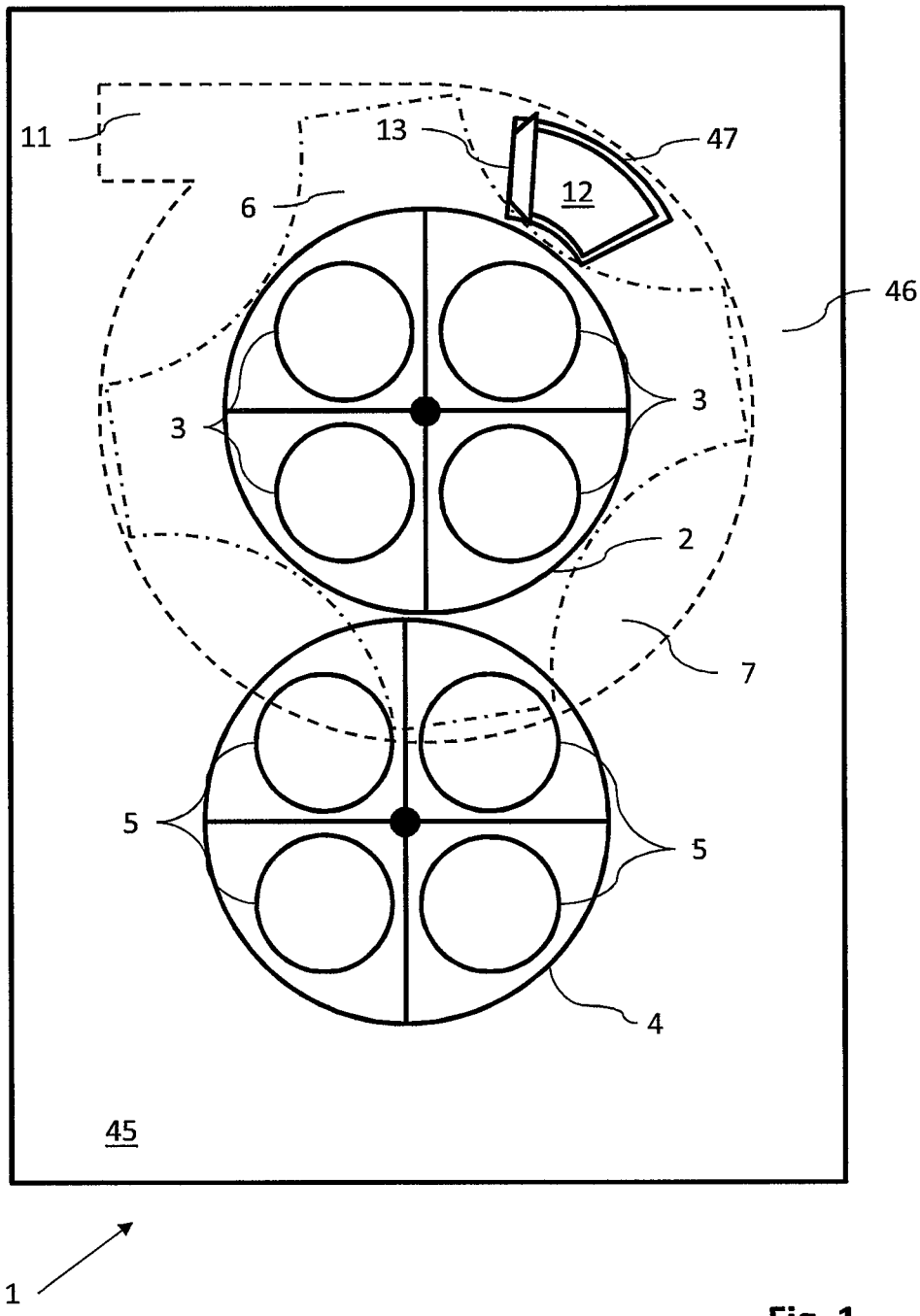
FIG. 1 shows a plan view of a coin transport mechanism of the present invention.

With reference to FIG. 1, a coin transport mechanism 1 of the present invention comprises a first coin rotor 2 and a second coin rotor 4 mounted on a common support structure 45.

The first coin rotor 2 includes a plurality of coin receptacles 3 and, correspondingly, the second coin rotor 4 includes a plurality of coin receptacles 5. Both the first coin rotor 2 and the second coin rotor 4 are substantially the same as that which is described in WO-A-2006/079803, with the exception that the second coin rotor 4 does not include the singulator arrangement, whereas the first coin rotor 2 does include a gated singulator arrangement (not shown).

Disposed beneath the top surface 46 of the support structure 45, and shown in broken line in FIG. 1, are circular coin path 7, coin output path 11, and radially projecting arm members 6.

As shown in FIG. 1 (see also FIGS. 5A to 5C), a coin ejector 12 is positioned in the circular coin path 7 at a position corresponding to an opening 47 in the top surface 46 of the support structure 45. Also shown is a deflection member 13 that protrudes from the top surface 46 of the support structure 45 in a direction that is out of the plane of the top surface 46.

The coin ejector 12 is actuated by a solenoid (not shown) in response to coin sensor signals.

Figure 2:
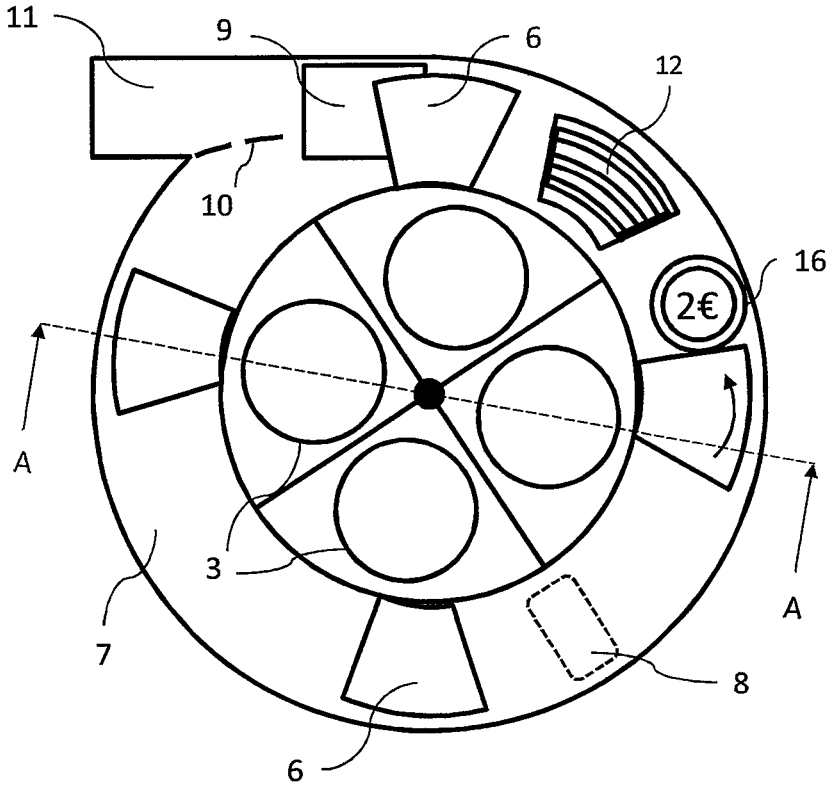
FIG. 2 shows a plan view of the first coin rotor with the top surface of the support structure removed.

With reference to FIG. 2, removal of the top surface 46 of the support structure reveals the generally circular coin path 7 leading, in an anticlockwise direction, to a coin output path 11. Also shown is a plurality of arm members 6 projecting radially from the central hub of the first coin rotor 2.

The circular coin path 7 traverses a coin sensor unit 8, the coin ejector 12, and a solenoid actuated trap door 9 positioned before coin diverter 10 and the coin output path 11. The trap door 9 opens into a coin storage container 50 (see FIG. 7), and the coin output path 11 leads to a coin output receptacle (not shown).

The coin diverter 10 comprises a plurality of rib portions forming an arcuate guide member for directing coins from the circular coin path 7 to the coin output path 11.

Figure 3:
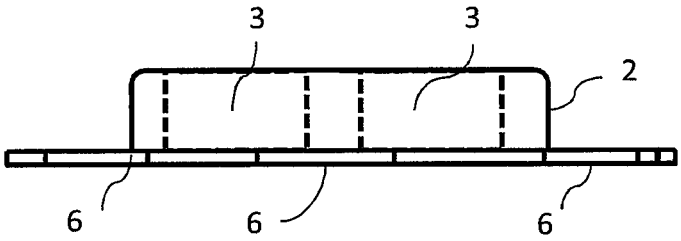
FIG. 3 shows an elevation view of the first coin rotor of FIG. 2.

FIG. 3 shows an elevation view of the first coin rotor 2 of FIG. 2. As can be seen, the coin receptacles 3 extend from the top surface of the rotor to the underside surface such that more than one coin can be held within a receptacle at any given time. The radially projecting arm members 6 extend in the vertical direction a distance that is slightly greater than, or substantially equal to, the thickness of the largest coin the coin mechanism is adapted to accept. However, it should be noted that the mechanism can be adapted to accept a variety of coin types and denominations.

Figure 4:
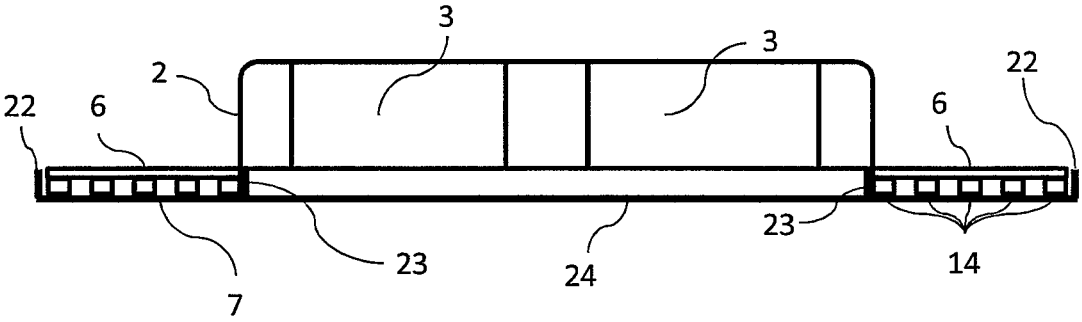
FIG. 4 shows a cross-sectional view along the line A-A showing FIG. 2.

FIG. 4 is a cross-sectional view along the line A-A shown in FIG. 2. As shown, the underside of each arm member 6 includes a plurality of rib portions 14 that extend radially between an edge proximal to a coin path inner wall 23 and an edge proximal to a coin path outer wall 22. The rib portions 14 depend from each arm member to form a crenelated structure adapted to cooperate with corresponding rib portions on the coin ejector 12 and the coin diverter 10 respectively. In order that the first coin rotor 2 can freely rotate, there is a clearance gap between the rib portions 14 and portions of a base platform 24 that form the floor of the circular coin path between the inner wall 23 and the outer wall 22. Likewise, there is a clearance gap between the outer wall 22 and the circumferential edge of the arm members 6.

Figure 6:
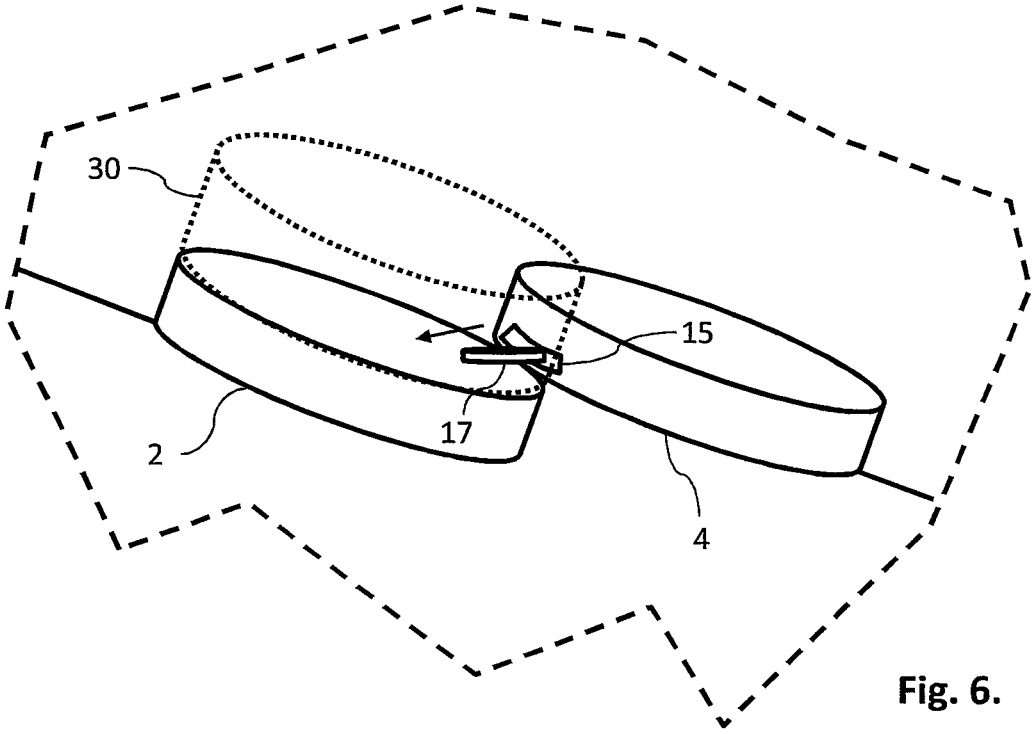
FIG. 6 shows a schematic partial view of the first and second coin rotors.

FIG. 6 shows a partial, close-up schematic diagram of the coin mechanism coin rotors. As shown, the first coin rotor 2 is parallel to, but non-coplanar with, the second coin rotor. Both the first coin rotor 2 and the second coin rotor 4 are inclined with respect to the horizontal (see also FIG. 7). The second coin rotor 4 includes a coin slot 15 that communicates with a coin receiving compartment 30 (shown in broken line). The coin receiving compartment 30 forms part of a housing that either encloses or sits directly above the first coin rotor 2.

Figure 7:
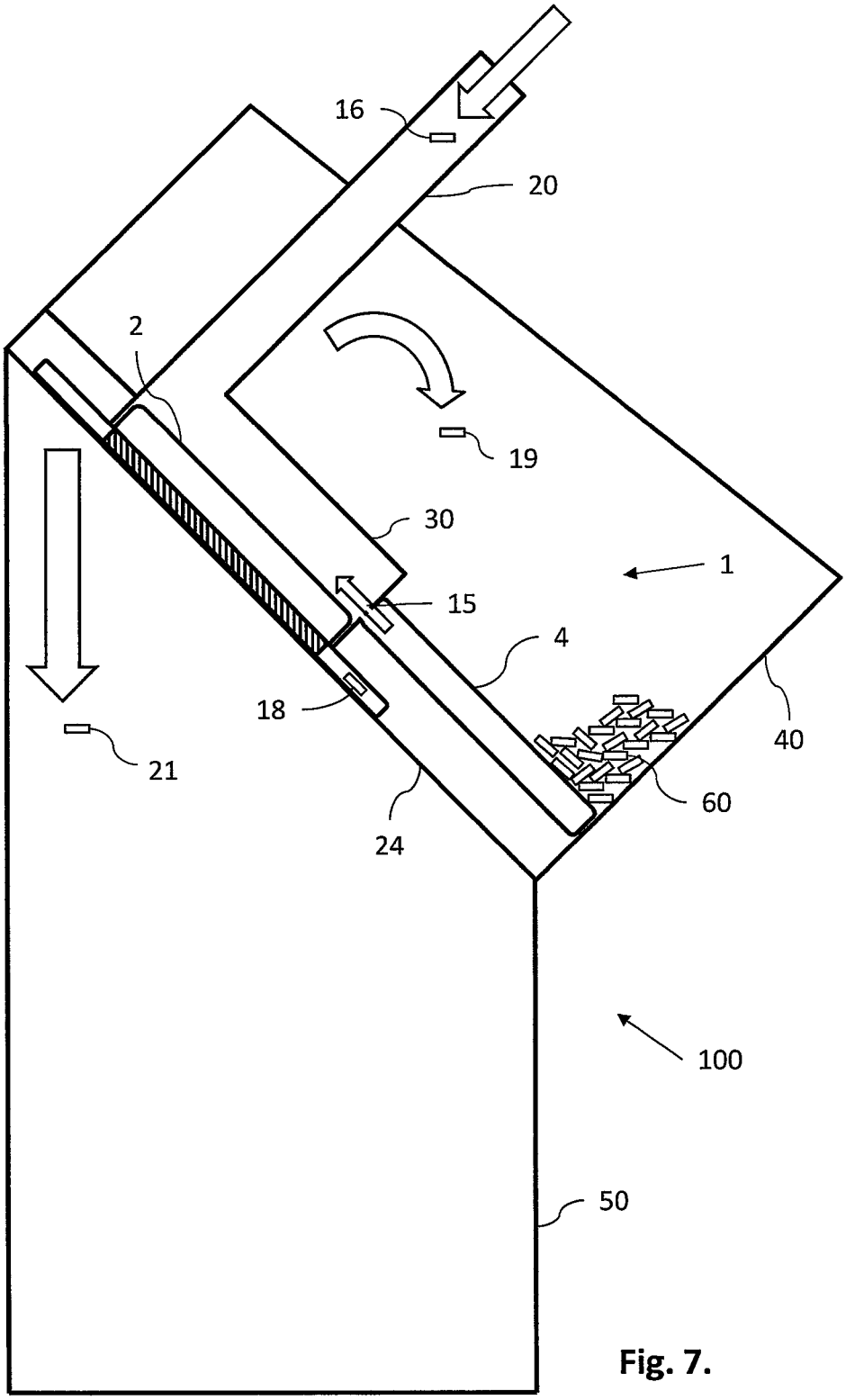
FIG. 7 shows a coin handling apparatus incorporating a coin transport mechanism of the present invention.

FIG. 7 illustrates a coin handling apparatus 100 including a coin transport mechanism of the present invention.

The coin handling mechanism 100 comprises a coin hopper 40 supported by and connected to a coin storage container 50. The coin hopper 40 houses the coin mechanism 1 and the coin receiving compartment 30, and in operation holds a bulk supply of coins 60.

As shown in FIG. 7, a coin input conduit 20 for receiving coins, tokens or the like, communicates with the coin receiving compartment 30.

Figure 8:
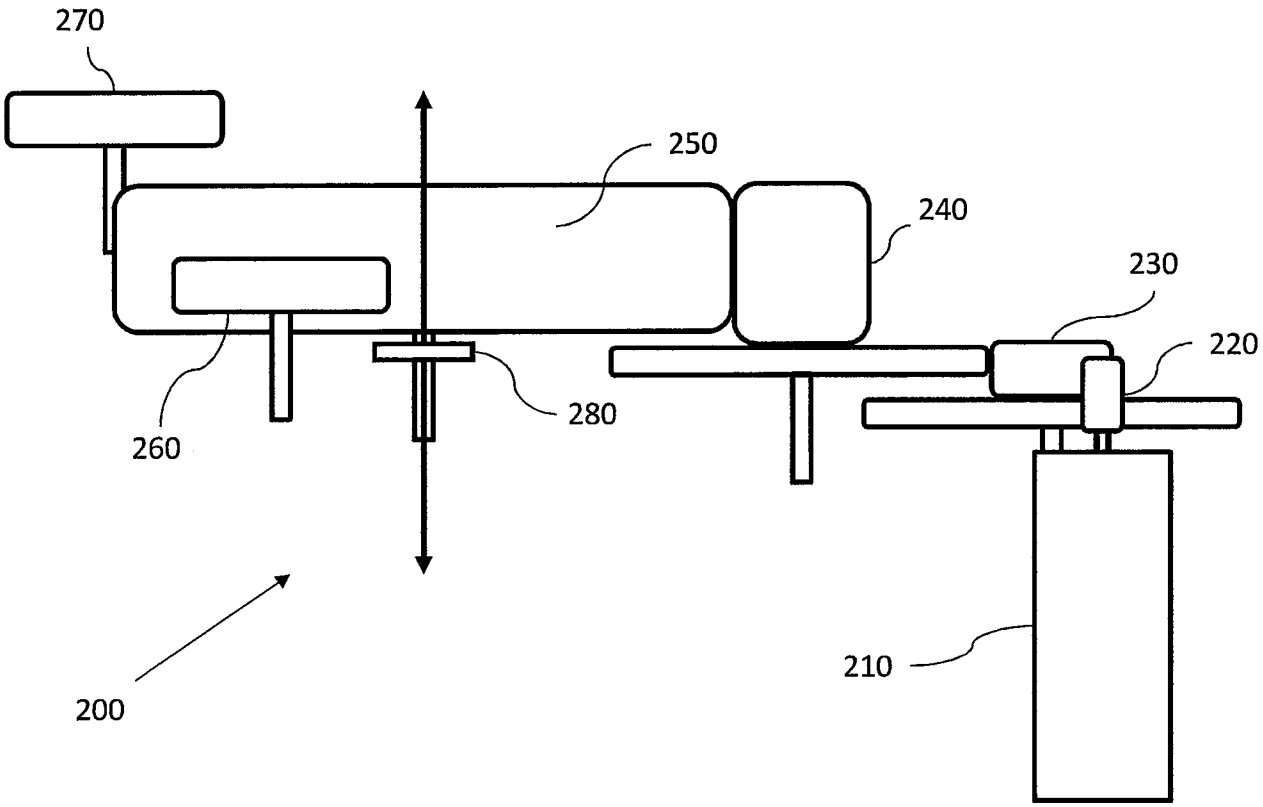
FIG. 8 shows an elevation view of a coin transport gear train.
Figure 9:
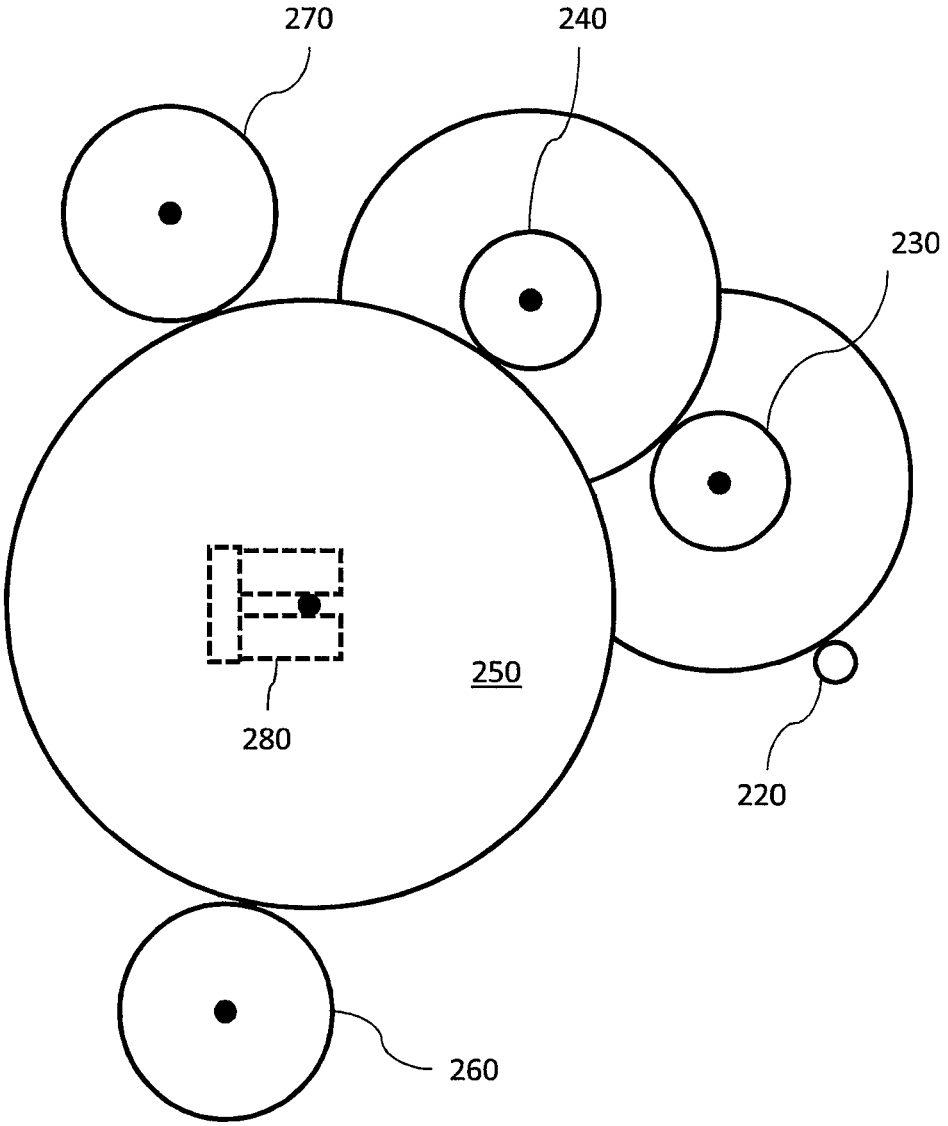
FIG. 9 shows a plan view of the gear train of FIG. 8.

FIG. 8 illustrates an example of a motor drive and gear train 200 for operating the coin mechanism 1 of the present invention, and FIG. 9 shows a plan view of the gear train 200 shown in FIG. 8.

A motor 210 provides rotational motion to gear wheel 230 via motor drive gear wheel 220. Rotational motion is transmitted to gear wheel 260 via meshed gears 230, 240 and 250. Gear wheel 270 is connected to the first coin rotor 2, and gear wheel 260 is connected to the second coin rotor 4.

Gear wheel 250 is moveable in axial direction by operation of lifting means 280 secured to the axle of gear wheel 250. Operation of lifting means 280 enables gear wheel 250 to be unmeshed from gear wheel 260 and displaced until it meshes with gear wheel 270. Alternatively, lifting means 280 can be actuated such that gear wheel 250 remains meshed with gear wheel 260, but also meshed with gear wheel 270. In this way, the single motor 210 is able to drive the first coin rotor 2 solely, to drive the second coin rotor 4 solely, or drive both the first and the second coin rotors simultaneously.

In operation, and as shown in FIG. 7, a coin or coins 16 are introduced into the coin input conduit 20 and fall under gravity into the coin receiving compartment 30. Coins collect in the coin receiving compartment 30 and are separated and introduced into the circular coin path 7 via operation of the first coin rotor 2 and the singulator (not shown) as described more fully in WO-A-2006/079803.

As shown in FIG. 2, after being expelled from the first coin rotor 2, a coin 16 is propelled around the circular coin path 7 through contact with a radially projecting arm member 6 and by rotation of the first coin rotor 2. As the coin traverses the coin path 7 it passes a coin sensor 8 which detects various characteristics of the coin to establish its authenticity and denomination. The coin sensor 8 will typically comprise a selection of induction coils as is well known in the art. However, it is envisaged that other coin sensor arrangements can be deployed dependent upon the overall requirements of a given application.

As the coin 16 travels between the coin sensor 8 and the coin ejector 12 a remote processor (not shown) determines if the coin 16 is authentic and of the desired denomination based upon the sensed signals from coin sensor 8. If these criteria are met the processor determines if the coin is to be stored in the coin storage container 50 or held in the coin hopper 40 for future payout.

If the processor determines that the coin 16 is intended for the coin storage container 50, then the coin 16 traverses the coin ejector 12, which is not activated, and the coin 16 continues to the trap door 7 which is biased in a closed position. At this juncture the processor actuates a solenoid which opens the trap door 9, and further rotation of the first coin rotor 2 pushes the coin 16 over the edge of the trap door 9 opening from where it falls as coin 21 into the coin storage container 50 under gravity (see FIG. 7).

If the processor determines that the coin 16 is not authentic (or of the incorrect denomination) both the coin ejector 12 and the trap door 9 remain inactivated, and the coin 16 travels passed the closed trap door 9 to be diverted by the coin diverter 10 into a coin output path 11 which ultimately leads to the coin output receptacle from where it can be collected by a user.

Alternatively, if the processor has determined that coin 16 is authentic and of the correct denomination, but it is required to be added to the bulk supply of coins 60 residing in the coin hopper 40, then the processor activates the coin ejector 12 by actuation of the coin ejector solenoid (not shown) before the coin 16 reaches the coin ejector 12.

Figure 5A:
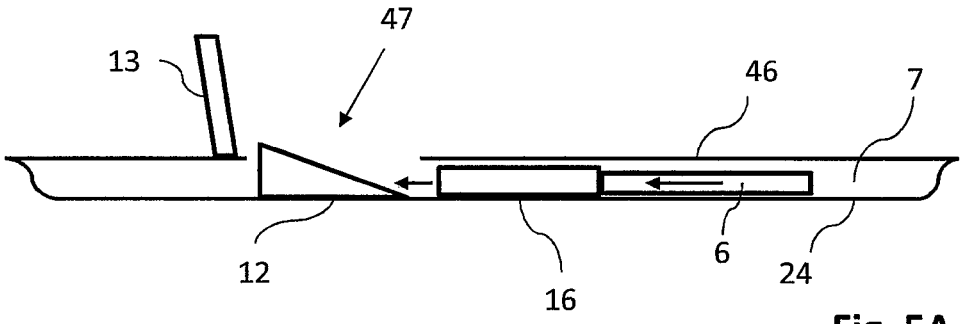
FIGS. 5A to 5C show the ejection of a coin from the transport mechanism.
Figure 5B:
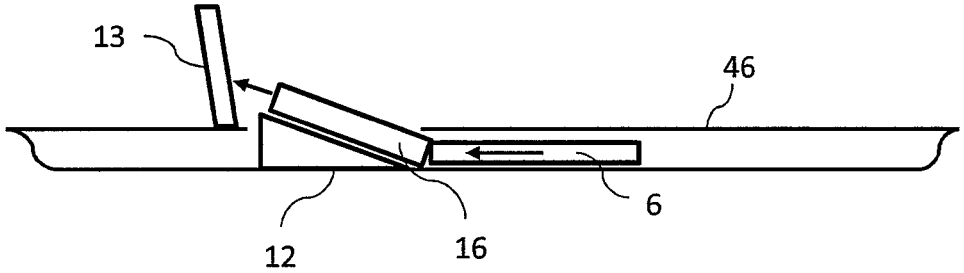
Figure 5C:
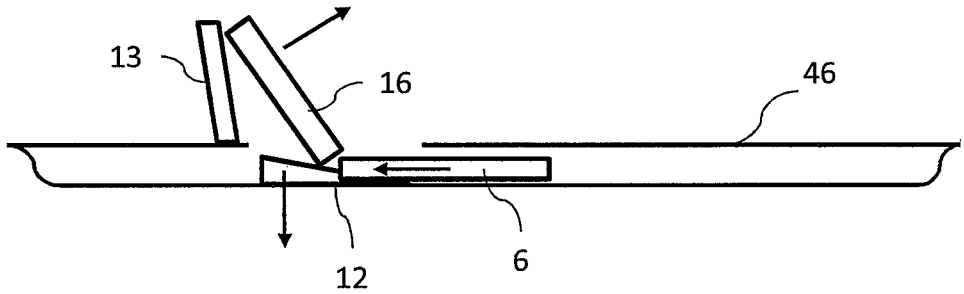

With reference to FIGS. 5A to 5C, the circular coin path 7 is enclosed by the top surface 46 of the support structure 45 and the base platform 24. As the coin 16 approaches the activated coin ejector 12, which now protrudes from the base platform 24 into the coin path, the radially projecting arm member 6 pushes the coin 16 up and outwards until it is deflected by deflection member 13 to fall under gravity as coin 19 into the coin hopper 40 to be added to the bulk coin supply 60 (see FIG. 7).

As shown in FIG. 5C, the coin ejector 12 is resiliently biased when activated such that as the advancing arm member 6 passes over the coin ejector 12 it is urged downwards through engagement of the corresponding rib portions of both the coin ejector 12 and the underside of the arm member 6 (see FIGS. 2 and 4).

Coin Payout

When the processor determines that a payout condition has arisen, the second coin rotor 4 is actuated and coins from the bulk supply of coins 60 held in the coin receptacles 5 of the second coin rotor 4 are transported via rotation of the second coin rotor 4 upwards in an anticlockwise manner towards the first coin rotor 2.

As shown in FIG. 6, a coin 17 from the coin hopper 40 is transferred from the second coin rotor 4 into the coin receiving compartment 30 from where it will descend into one of the coin receptacles 3 of the first coin rotor 2. Coin 17 will then be transferred to the circular coin path 7 in a similar manner to that which is described above.

The denomination of coin 17 will be determined on passing the coin sensor 8 and, if it is determined to be of the correct denomination, it will propelled around the coin path 7 by a radially projecting arm member 6 to be diverted into the coin output path 7 by the coin diverter 10. On the other hand, if the coin 17 is determined to be of the wrong denomination for payout it will be either ejected back into the coin hopper 40 by operation of the coin ejector 12, or it will drop into the coin storage container 50 through the open trap door 9 if the processor has determined that there is a surplus number of coins of the determined denomination within the coin hopper 40.

Advantageously, the coin mechanism of the present invention can perform both a validation and a payout operation without the need for a large and costly coin lifting mechanism. Furthermore, both operations can be performed via the same coin path with the need to only employ a single coin sensor unit and a single motor to operate both coin rotors.

The invention claimed is:

1. A coin transport mechanism comprising:

a first coin rotor including at least one coin receptacle for receiving a coin;

a second coin rotor including at least one coin receptacle, the second coin rotor disposed proximal to the first coin rotor;

a coin sensor;

wherein the first coin rotor is noncoplanar with the second coin rotor and includes a gated coin aperture, and wherein the second coin rotor is adapted to transport coins from a coin hopper to the first coin rotor; and wherein the first coin rotor includes a plurality of radially projecting arm members which, upon rotation of said first coin rotor, traverse a substantially circular coin path disposed circumferentially of the first coin rotor, and wherein a coin expelled from the gated coin aperture is urged to traverse the substantially circular coin path by one of the plurality of radially projecting arm members acting upon the coin under rotation of the first coin rotor such that said coin traverses said coin sensor;

wherein the substantially circular coin path includes a retractable coin ejector, wherein operation of the retractable coin ejector on a traversing coin ejects said coin out of the substantially circular coin path into the coin hopper;

wherein the substantially circular coin path includes a solenoid activated trap door communicating with a coin storage container;

wherein the substantially circular coin path includes at least one diverter member for guiding a coin from the substantially circular coin path to a coin output path, and wherein a section of the substantially circular coin path traverses the coin sensor adapted to provide signals indicative of coin characteristics; and wherein a portion of the substantially circular coin path is disposed beneath the second coin rotor, and wherein the substantially circular coin path and the coin output path are disposed beneath the common support structure.

2. A coin transport mechanism comprising:

a first coin rotor including at least one coin receptacle for receiving a coin;

a second coin rotor including at least one coin receptacle, the second coin rotor disposed proximal to the first coin rotor;

a coin sensor;

wherein the first coin rotor is noncoplanar with the second coin rotor and includes a gated coin aperture, and wherein the second coin rotor is adapted to transport coins from a coin hopper to the first coin rotor; and wherein the first coin rotor includes a plurality of radially projecting arm members which, upon rotation of said first coin rotor, traverse a substantially circular coin path disposed circumferentially of the first coin rotor, and wherein a coin expelled from the gated coin aperture is urged to traverse the substantially circular coin path by one of the plurality of radially projecting arm members acting upon the coin under rotation of the first coin rotor such that said coin traverses said coin sensor;

wherein the substantially circular coin path includes a retractable coin ejector;

wherein operation of the retractable coin ejector on a traversing coin ejects said coin out of the substantially circular coin path into the coin hopper;

wherein the substantially circular coin path includes a solenoid activated trap door communicating with a coin storage container;

wherein the substantially circular coin path includes at least one diverter member for guiding a coin from the substantially circular coin path to a coin output path, and wherein a section of the substantially circular coin path traverses the coin sensor adapted to provide signals indicative of coin characteristics;

wherein a portion of the substantially circular coin path is disposed beneath the second coin rotor, and wherein the substantially circular coin path and the coin output path are disposed beneath the common support structure; and wherein a section of the substantially circular coin path coincident with the retractable coin ejector is exposed through the common support structure.

3. A coin transport method comprising:

a first coin rotor receiving a first coin in a coin receptacle;

transporting the first coin by rotation of the first rotor to an outer circumferential coin path via a gated coin aperture;

transporting the first coin along the outer circumferential coin path so as to traverse a coin sensor;

determining if the first coin is authentic and, if said first coin is authentic, transporting said coin to either a coin hopper or a coin storage container;

transporting a second coin from the coin hopper to the first coin rotor via a second coin rotor disposed proximal to the first coin rotor;

transporting, by rotation of the first coin rotor, the second coin along the outer circumferential coin path so as to traverse the coin sensor; and determining if the second coin is of a desired denomination and, if said second coin is of the desired denomination, transporting said second coin to an output path.

* * * * *